US006226952B1

(12) United States Patent
Romeu Guardia

(10) Patent No.: US 6,226,952 B1
(45) Date of Patent: May 8, 2001

(54) DEVICE FOR ANCHORAGE TO A GRATING FLOOR

(75) Inventor: Gener Romeu Guardia, Agramunt (ES)

(73) Assignee: Rotecna, S.A., Agramunt (ES)

( * ) Notice: Subject to any disclaimer, the term of this patent is extended or adjusted under 35 U.S.C. 154(b) by 0 days.

(21) Appl. No.: 09/473,821

(22) Filed: Dec. 28, 1999

(30) Foreign Application Priority Data

Dec. 29, 1998 (ES) ..... 9802698

(51) Int. Cl.[7] ..... F16B 21/00

(52) U.S. Cl. ..... 52/698; 52/660; 52/665; 52/709; 411/85; 411/345; 411/346

(58) Field of Search ..... 52/660, 661, 662, 52/663, 664, 665, 666, 667, 668, 669, 670, 671, 698, 708, 709, 711; 411/84, 85, 340, 344, 345, 346

(56) References Cited

U.S. PATENT DOCUMENTS

| | | | | |
|---|---|---|---|---|
| 2,126,307 | * | 8/1938 | Boedeker | 52/507 |
| 2,572,432 | * | 10/1951 | Bates | 52/507 |
| 2,770,336 | * | 11/1956 | Vevirit et al. | 52/581 |
| 3,106,271 | * | 10/1963 | McGee | 52/489.1 |
| 3,263,388 | * | 8/1966 | Bogert | 52/665 |
| 3,685,243 | * | 8/1972 | Wyss | 52/665 |
| 3,742,671 | * | 7/1973 | Ellis | 52/666 |
| 3,900,998 | * | 8/1975 | Hubbard | 52/698 |
| 4,043,245 | * | 8/1977 | Kaplan | 411/346 |
| 4,286,497 | * | 9/1981 | Shamah | 411/345 X |
| 4,294,156 | * | 10/1981 | McSherry et al. | 411/345 |
| 4,439,079 | * | 3/1984 | Losada | 411/345 |
| 4,650,386 | * | 3/1987 | McSherry et al. | 411/340 |
| 5,184,922 | * | 2/1993 | Blackwell | 411/344 X |
| 5,779,412 | * | 7/1998 | Nagai et al. | 411/85 |

* cited by examiner

*Primary Examiner*—Beth A. Stephan
*Assistant Examiner*—Brian E. Glessner
(74) *Attorney, Agent, or Firm*—Darby & Darby

(57) ABSTRACT

A device for anchorage to a grating floor.

The device includes a lower element the cross-section of which is larger than the width of the openings in the grating in one direction and is narrower in the other direction so that it can pass through the grating after pivoting through 90°, the lower element housing a nut in its lower face and having, on two of its lateral faces, respective housings with toothed regions on their respective upper portions, the toothed regions being complementary with an upper element of a width larger than the openings in the grating and having two legs of a width smaller than the openings in the grating, the legs having respective lower studs which can be introduced into the housings of the lower element, allowing the lower element to pivot, and respective teeth on the inner faces of the said legs for meshing with the teeth adjacent the housings for the studs in the lower element.

1 Claim, 8 Drawing Sheets

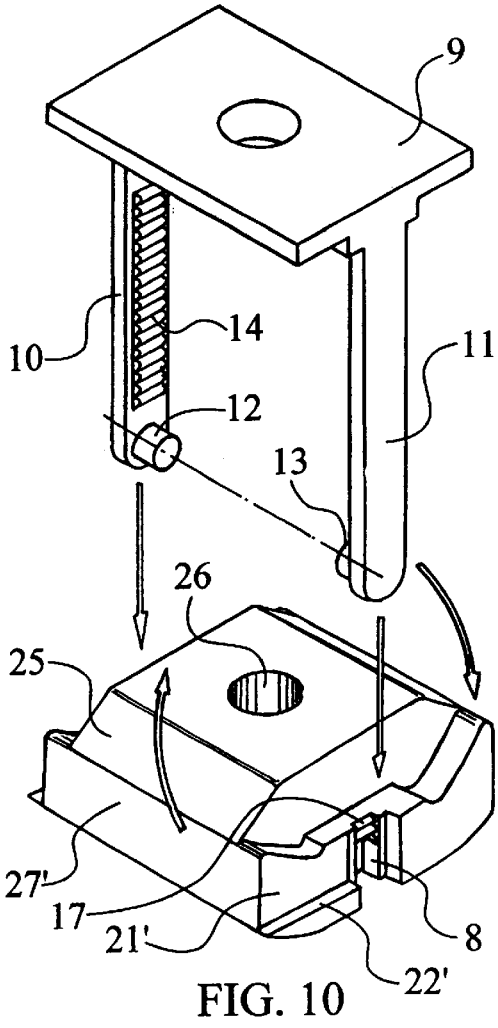
FIG. 10
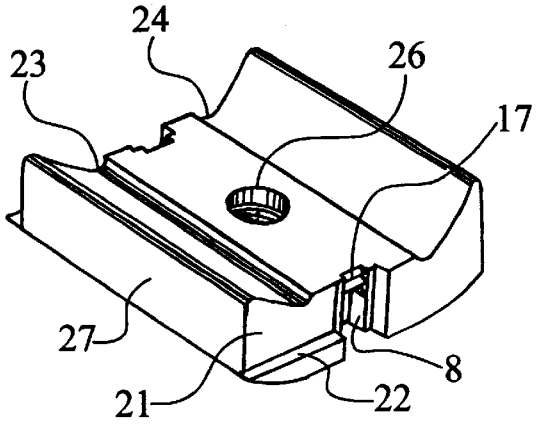
FIG. 10 BIS

DEVICE FOR ANCHORAGE TO A GRATING FLOOR

DESCRIPTION

The present invention relates to a device for anchorage to a grating floor, particularly applicable to floors having gratings for the passage of fluids or substances to be collected below the said grating as is the case, for example, for gratings for farms and the like.

The object of the device of the invention is to solve the problem which arises when screwed anchorages are required on grating floors since, given the dimensions and weight of the gratings and their fixed installation, access to their lower sides is difficult.

The purpose of the device of the invention is to enable one person alone to perform the anchoring without requiring access to the lower side of the grating.

To fulfil its purpose, the device of the present invention comprises an element the geometry of which allows the element to be introduced into an opening in the grating and, after the element has pivoted through 90°, prevents its removal. This element may have various designs according to the type of grating on which it is to be installed. On its lower face, the element has a cavity in which a nut is housed with the necessary pressure. In two of its lateral faces, the element has respective housings in which studs can be located and, above the said studs, the element has respective guide regions.

There is also a further element which has the purpose of securing and orienting the first element and which is constituted by a rectangular top portion of a width larger than that of the openings in the grating. Two legs of a width smaller than that of the openings in the grating extend from the lower side of this top portion and have, in their lower portions, respective studs arranged to be introduced into the housings of the first element. On the same face as the studs, there is a set of saw-teeth which can mesh with the toothed regions situated above the guide regions.

For a better understanding, some drawings showing a preferred embodiment of the present invention are appended by way of non-limiting example.

FIG. 10 is a perspective view of the device showing the positioning of the two elements making up the support with a lower element for a concrete grating.

FIG. 10*bis* is is a perspective view of a variant of the lower element of FIG. 10 for a plastics grating.

Figure 1:
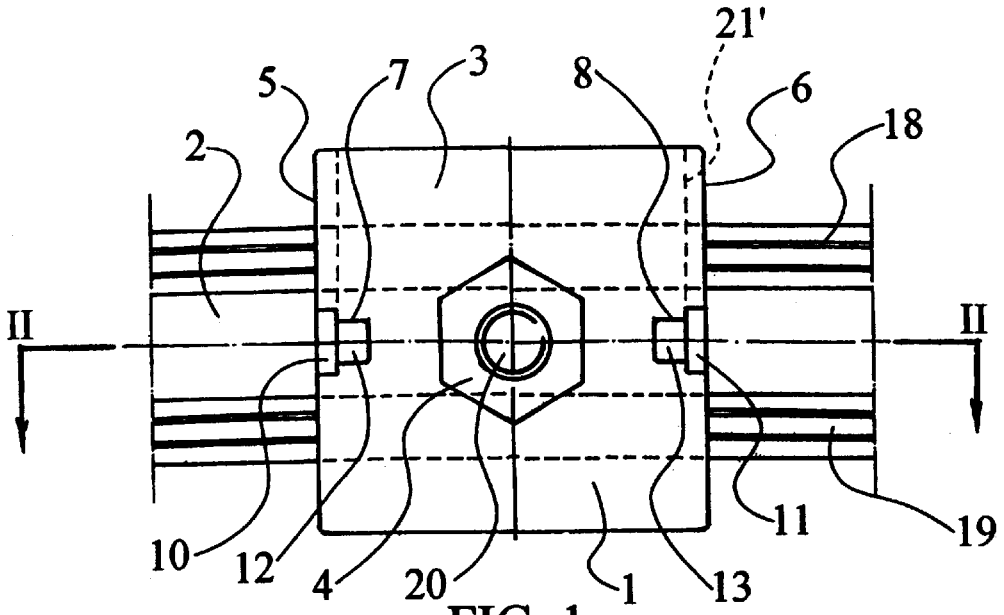
FIG. 1 is a view showing the device in its position relative to two elements of the grating, from the end having the nut.
Figure 2:
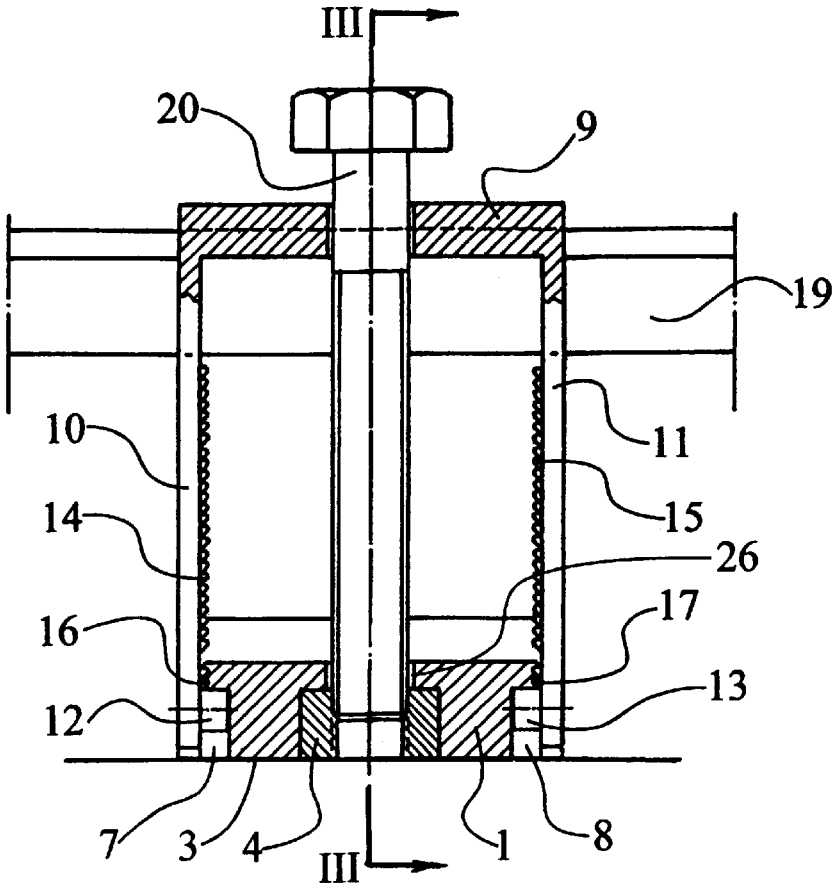
FIG. 2 is a section through the device in a median plane.
Figure 3:
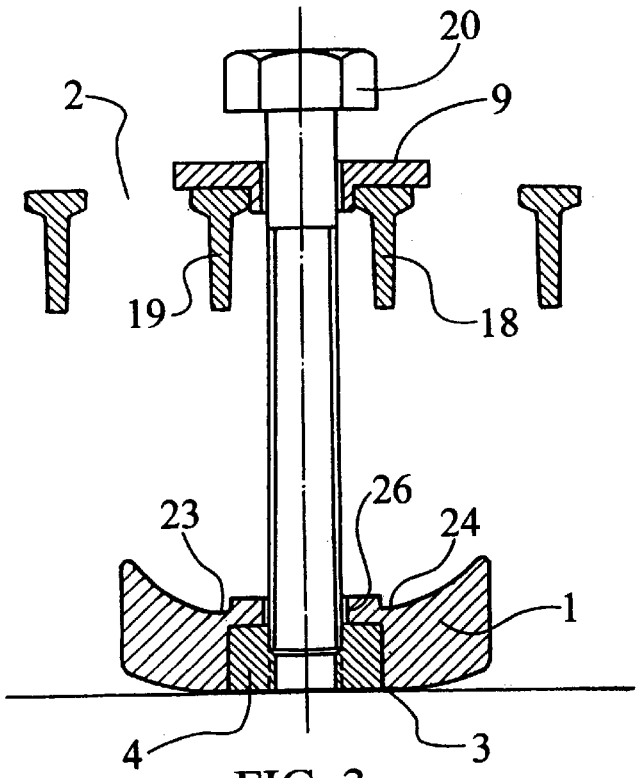
FIG. 3 is a schematic cross-section showing the positioning of the device relative to a grating of plastics material.
Figure 4:
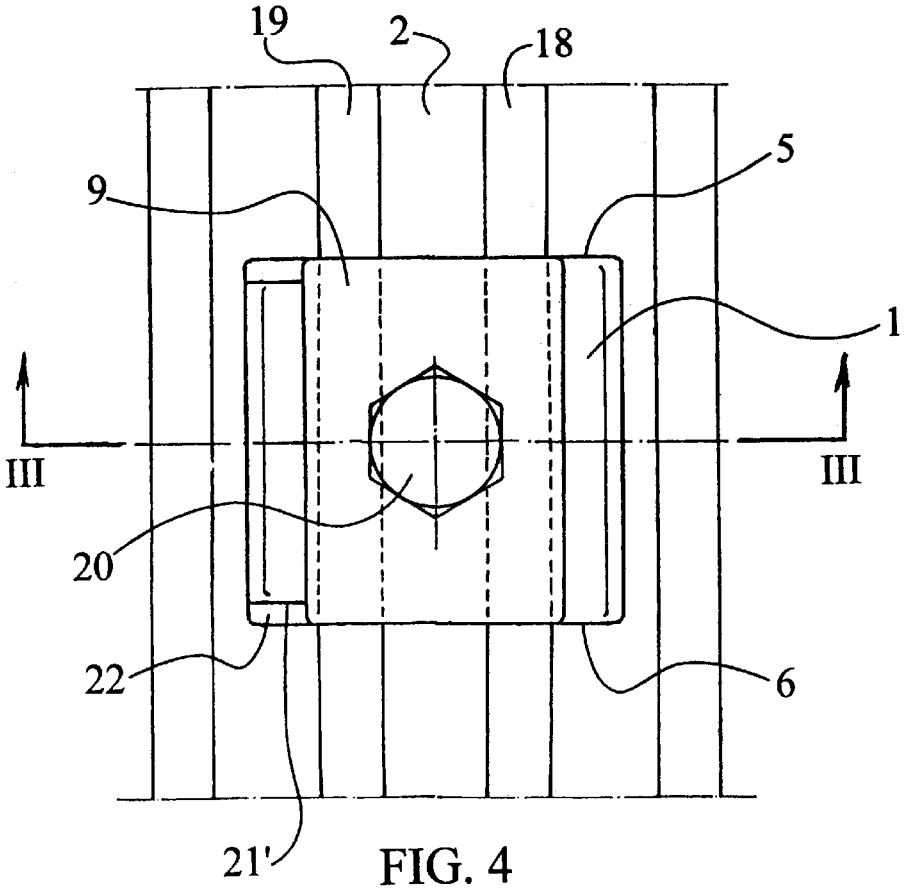
FIG. 4 is a plan view of the device of FIG. 3, from the end having the screw head.
Figure 5:
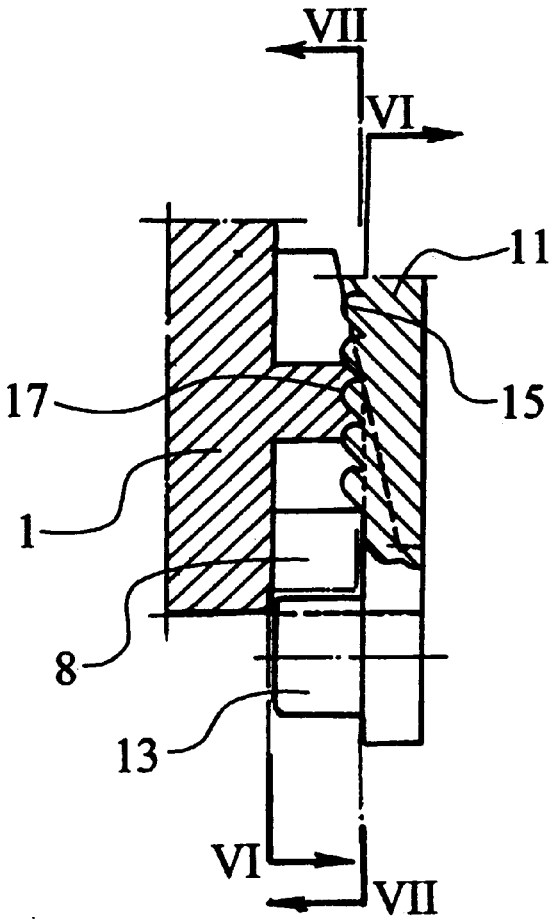
FIGS. 5, 6 and 7 are respective details of the coupling with the lateral teeth.
Figure 6:
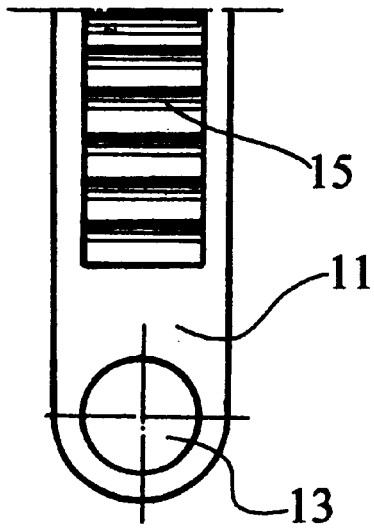
Figure 7:
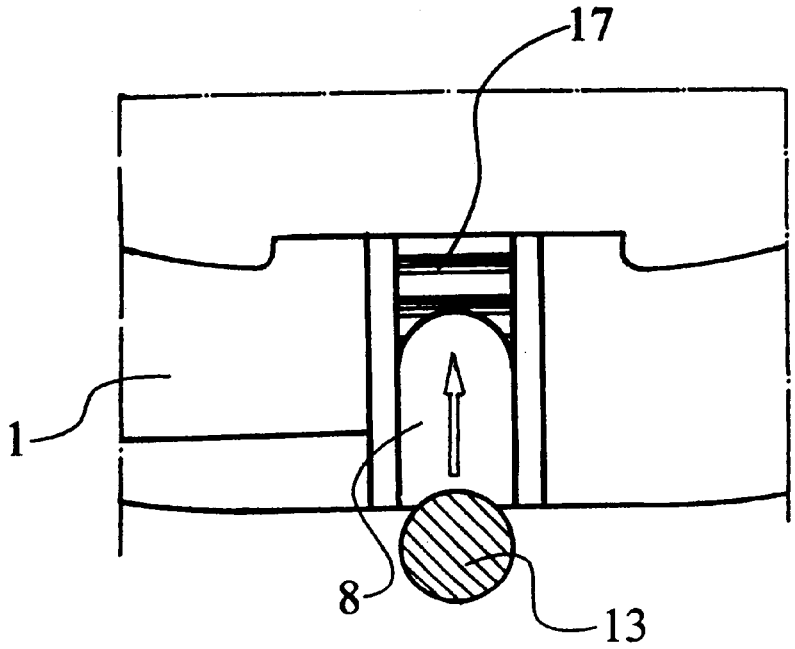
Figure 8:
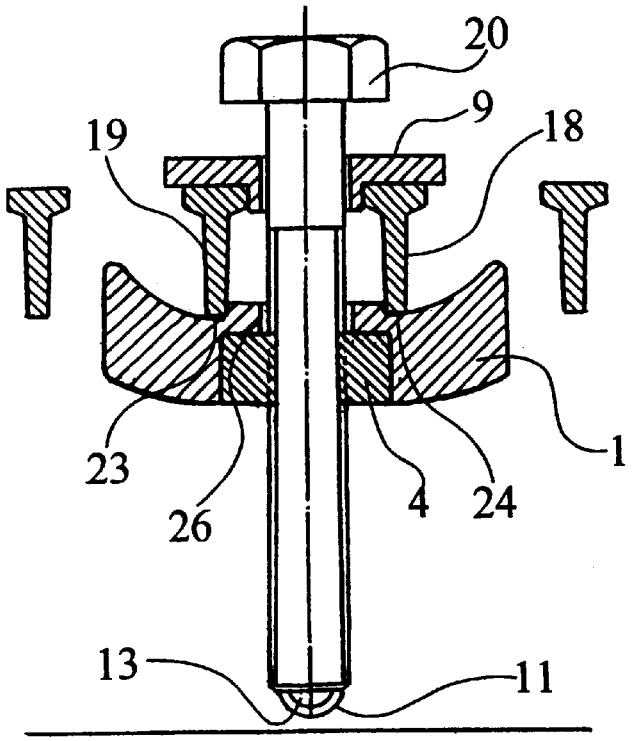
FIGS. 8 and 9 are respective schematic views of the elements shown in FIG. 3 in different positions and relative sections.
Figure 9:
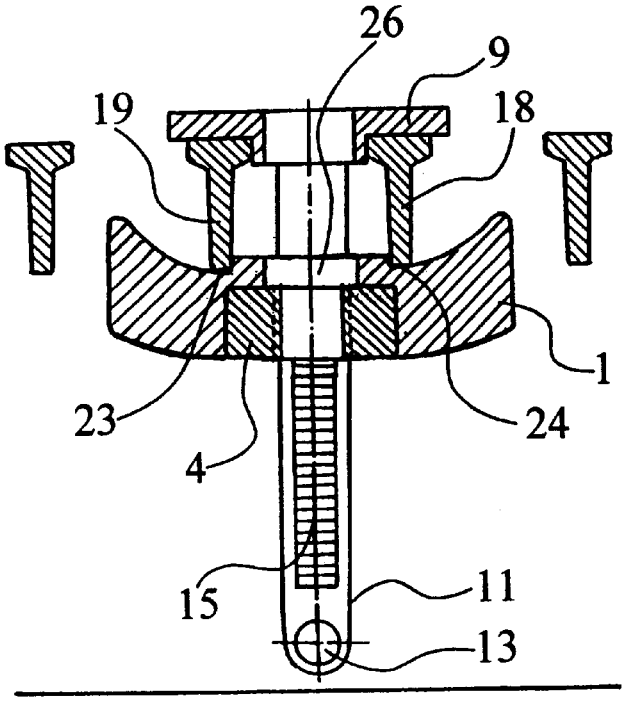
Figure 11:
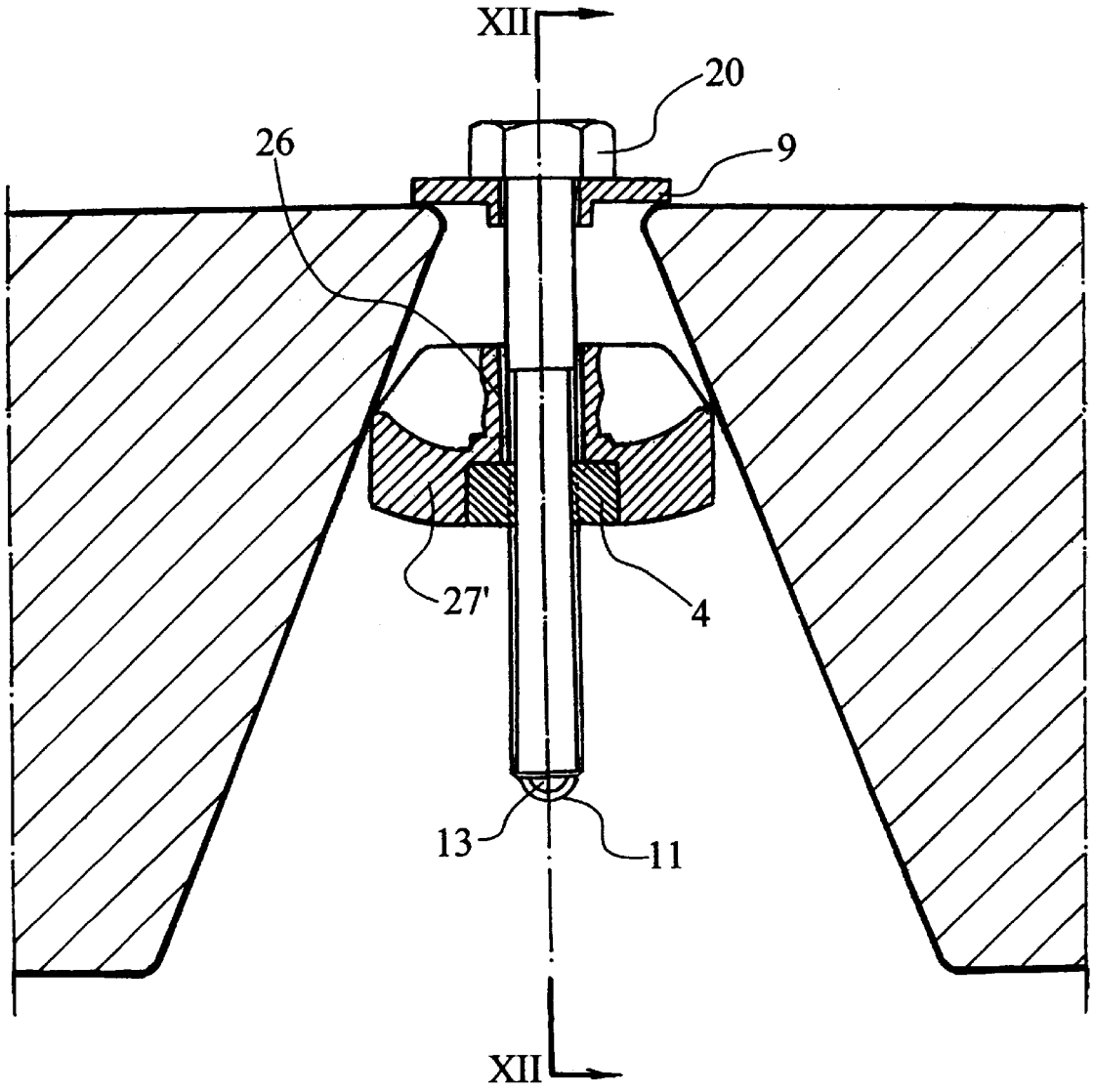
Figure 12:
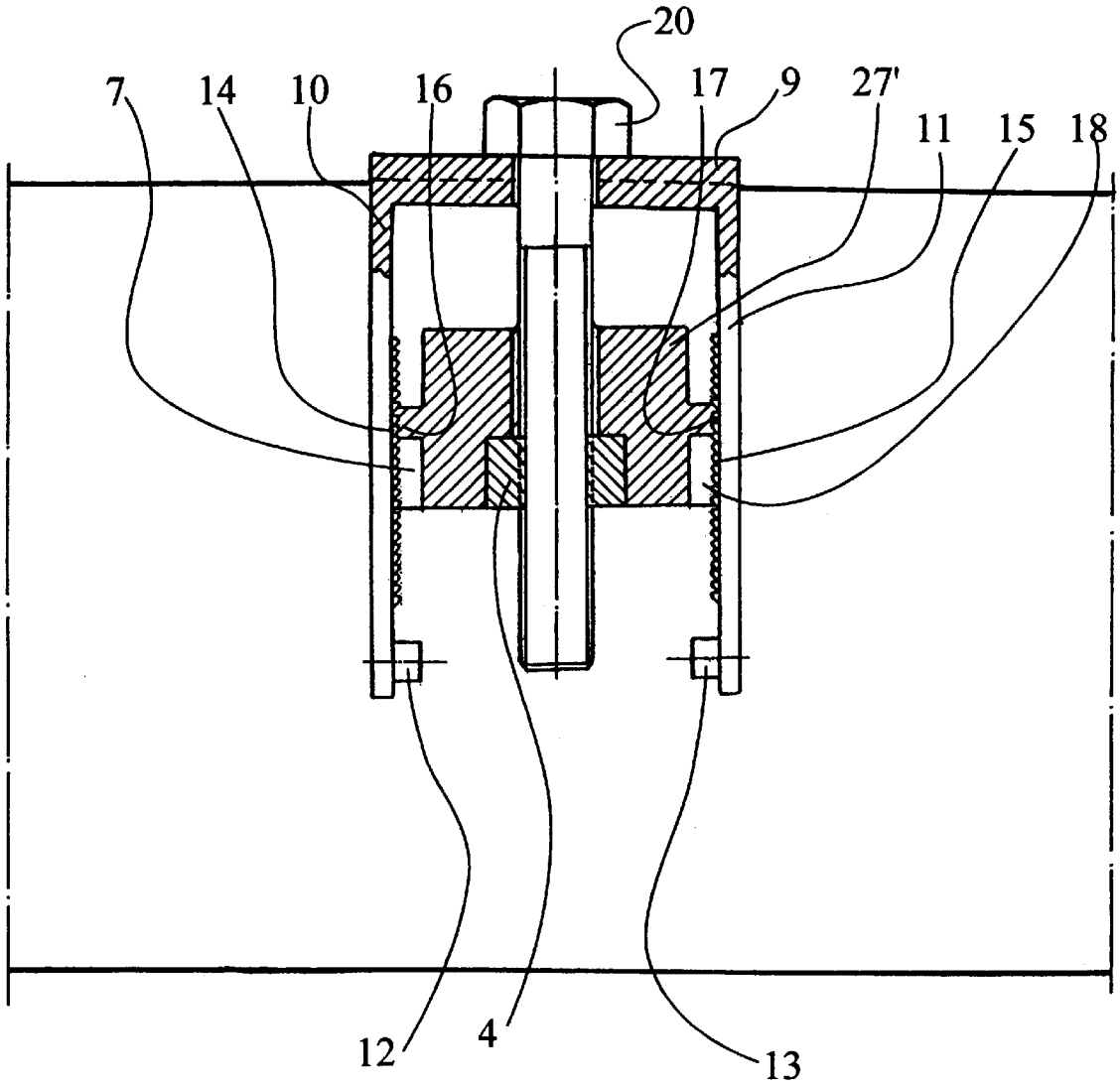

FIGS. 11 and 12 are respective cross-sections taken in the section planes indicated, for a concrete grating.

Figure 13:
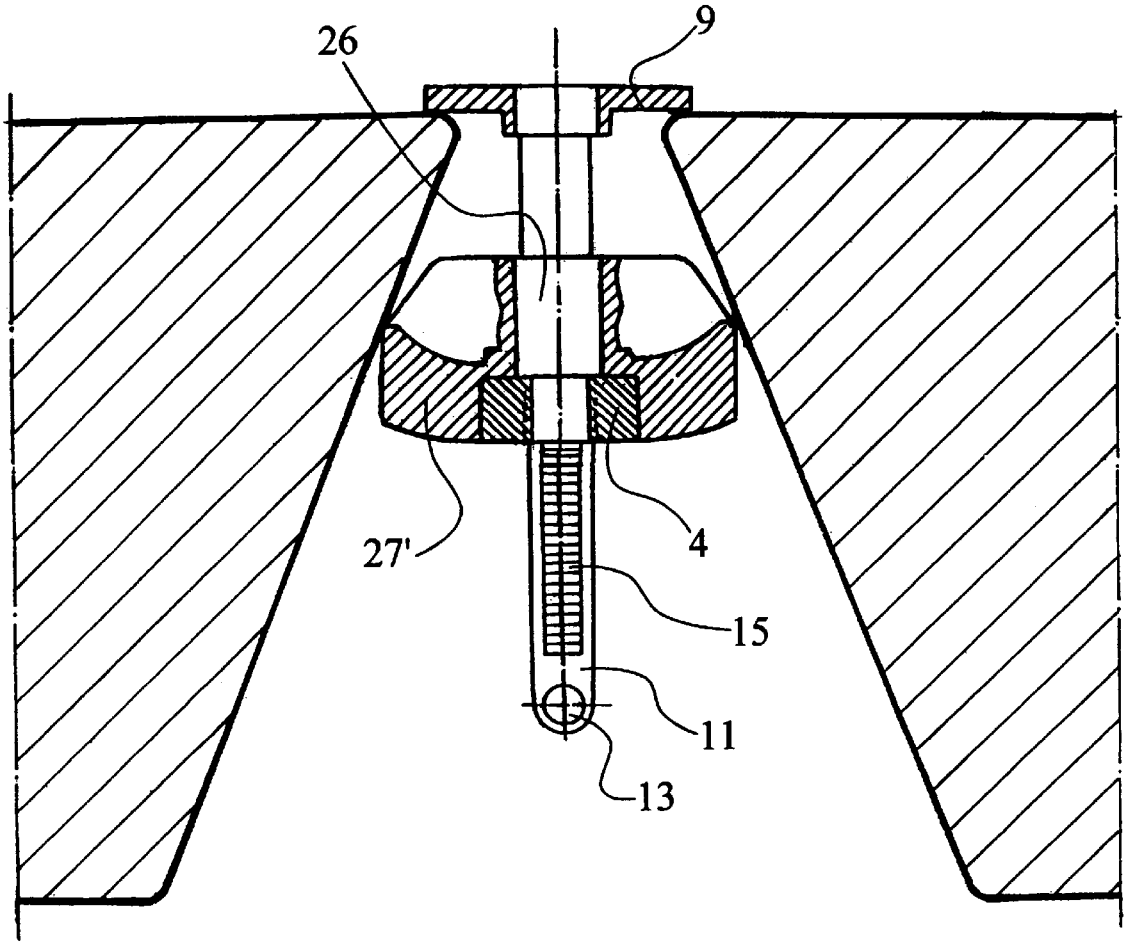

FIG. 13 shows a further detail, in section.

The device has a lower element 1, the geometry of which allows said element to be introduced into an opening 2 in the grating and, after the element has pivoted through 90°, prevents its removal. This element may be of various designs according to the type of grating on which it is to be installed. The element 1 has, on its lower face 3, a cavity in which a nut 4 is inserted with pressure. On two of its lateral faces 5 and 6, there are respective housings 7 and 8 in which cylindrical studs, which will be described, can be located.

The other main or upper element of the device is indicated 9, and is intended to secure and orient the element 1. The element 9 is constituted by a rectangular top portion which is of a width larger than that of the openings in the grating and from the lower side of which two legs 10 and 11 of a width smaller than that of the openings 2 in the grating extend, the legs having, at their lower ends, respective studs 12 and 13 to be introduced into the housings 7 and 8 of the element 1 which can pivot through 90° on the said studs so as to be able to pass through the grating. On the same faces on which the studs are disposed, there are teeth 14 and 15 which can mesh with teeth 16 and 17, FIG. 12, situated above the housings 7 and 8. In this version, which corresponds to a plastics grating, the lower element 27 has recesses 23 and 24 for receiving the longitudinal elements 18 and 19 of the grating. A face 21 is slightly inclined and has a step 22 for abutting the leg 11 after the pivoting through 90°. In the case of the lower element 27', for a concrete grating, FIGS. 10, 11, 12 and 13, there is an inclined lateral face 21' and a step 22' similar to those of the element 27 but, in the upper portion, it has a large projection 25 in which the hole 26 for the passage of the screw opens.

Once the lower element 1 has been put in position, with the nut inserted, and the thickness of the grating represented by the longitudinal elements 18 and 19 has been negotiated by pivoting through 90°, the element 1 will pivot owing to the action of the screw 20, the face of the nut will be positioned parallel to the floor, and the teeth of the legs will be ready to mesh with those of the lower element 1. The upper element 9 will bear against the grating and it will be possible to insert the screw 20 until it is coupled with the nut 4.

As the screw 20 is tightened, the studs 12 and 13 will be moved away but the teeth will continue to mesh in a manner such that, even if the screw is removed, the two elements making up the device will remain constantly attached.

What is claimed is:

1. A device for anchorage to a grating floor, characterized in that it comprises a lower element the cross-section of which is adapted to be larger than the width of openings in the grating in one direction and is narrower in the other direction, so that it can pass through the grating after pivoting through 90°, the lower element housing a nut in its lower face and having, on two of its lateral faces, respective housings, with toothed regions on their the respective upper portions, the toothed regions being complementary with a second or upper element adapted to be situated above the grating and of a width larger than the openings in the grating, the upper element having two legs adapted to be of a width smaller than the openings in the grating in order to pass through its openings, the legs having, on their lower ends, respective studs arranged to be introduced into the housings of the element carrying the nut, allowing the lower element to pivot, and respective teeth on the inner faces of said legs meshing with the teeth adjacent the housings for the studs in the lower element in order to retain the lower element in the absence of a screw.

* * * * *